US008820195B2

(12) United States Patent
Pelletier et al.

(10) Patent No.: US 8,820,195 B2
(45) Date of Patent: Sep. 2, 2014

(54) BIT OR FASTENER DRIVER

(75) Inventors: Thomas Pelletier, Wallingford, CT (US); Daniel Chang, Shengang Township (TW)

(73) Assignee: Stanley Black & Decker, Inc., New Britain, CT (US)

( * ) Notice: Subject to any disclaimer, the term of this patent is extended or adjusted under 35 U.S.C. 154(b) by 112 days.

(21) Appl. No.: 12/829,248

(22) Filed: Jul. 1, 2010

(65) Prior Publication Data

US 2012/0000324 A1 Jan. 5, 2012

(51) Int. Cl.
*B25B 23/16* (2006.01)
*B25B 13/06* (2006.01)

(52) U.S. Cl.
USPC ..... 81/60; 81/124.4; 81/177.2

(58) Field of Classification Search
USPC ..... 81/60, 177.2, 177.85, 124.4, 125.1, 81/437, 439, 63.1
See application file for complete search history.

(56) References Cited

U.S. PATENT DOCUMENTS

| | | | | | |
|---|---|---|---|---|---|
| 1,424,202 | A | * | 8/1922 | Wilkins | 81/124.4 |
| 1,930,238 | A | * | 10/1933 | Courvoisier | 81/124.4 |
| 2,346,364 | A | | 4/1944 | Dowe | 279/83 |
| 2,697,370 | A | * | 12/1954 | Brooks | 81/177.85 |
| 3,113,479 | A | | 12/1963 | Swingle | 81/177.2 |
| 3,289,503 | A | | 12/1966 | Klatt, Jr. | 81/436 |
| 3,592,086 | A | | 7/1971 | Derwin | 81/177.2 |
| 3,672,419 | A | | 6/1972 | Fischer | 81/460 |
| 4,893,529 | A | | 1/1990 | Lin | 81/177.4 |
| 5,157,994 | A | | 10/1992 | Krivec | 81/63.2 |
| 5,186,083 | A | * | 2/1993 | Hsiao | 81/124.4 |
| 5,365,811 | A | * | 11/1994 | Chi | 81/439 |
| D356,239 | S | | 3/1995 | Lin | D8/82 |
| 5,421,225 | A | | 6/1995 | Chen | 81/490 |
| 5,535,648 | A | | 7/1996 | Braun et al. | 81/63.1 |
| 5,537,899 | A | | 7/1996 | Diedrich | 81/57.39 |
| 5,822,830 | A | | 10/1998 | Lin | 16/422 |
| 6,109,141 | A | | 8/2000 | Nurmi | 81/63 |
| 6,125,722 | A | | 10/2000 | Hopper, Jr. et al. | 81/63 |
| 6,134,990 | A | | 10/2000 | Ling et al. | 81/60 |
| 6,151,997 | A | | 11/2000 | Lin | 81/177.4 |
| 6,186,030 | B1 | | 2/2001 | Whitley | 81/58.3 |
| 6,282,992 | B1 | | 9/2001 | Hu | 81/63.2 |
| 6,305,248 | B1 | | 10/2001 | Rowlay | 81/62 |
| 6,378,701 | B1 | | 4/2002 | Kuo | 206/378 |
| 6,427,564 | B1 | * | 8/2002 | Nelson | 81/177.2 |
| 6,453,779 | B2 | | 9/2002 | Hu | 81/63 |
| 6,457,389 | B1 | | 10/2002 | Hu | 81/63.2 |
| 6,575,060 | B1 | | 6/2003 | Tseng et al. | 81/63.2 |
| 6,666,112 | B2 | | 12/2003 | Hu | 81/63.1 |
| 6,739,224 | B1 | | 5/2004 | Wershe | 81/437 |
| 6,951,154 | B2 | | 10/2005 | Hsien | 81/60 |
| 7,017,453 | B2 | | 3/2006 | Hu | 81/63.2 |
| 7,044,029 | B1 | | 5/2006 | Hopper, Jr. et al. | 81/60 |
| 7,127,766 | B1 | | 10/2006 | Carter | 7/138 |
| 7,207,247 | B1 | | 4/2007 | Kirby | 81/436 |
| D547,624 | S | | 7/2007 | Strahorn | D8/21 |
| D552,949 | S | | 10/2007 | Strahorn | D8/21 |
| 7,278,339 | B2 | | 10/2007 | Hu | 81/63.2 |

(Continued)

*Primary Examiner* — Hadi Shakeri

(74) *Attorney, Agent, or Firm* — Pillsbury Winthrop Shaw Pittman LLP

(57) ABSTRACT

A tool includes a first bit receiving socket, a second bit receiving socket, and an angled metal structure. The angled metal structure includes a first end connected with the first bit receiving socket and a second end connected with the second bit receiving socket.

26 Claims, 3 Drawing Sheets

(56) References Cited

U.S. PATENT DOCUMENTS

| | | | | |
|---|---|---|---|---|
| 7,287,448 | B2 | 10/2007 | Hu | 81/60 |
| D555,445 | S * | 11/2007 | Strahorn | D8/21 |
| 7,299,720 | B1 | 11/2007 | Schultz et al. | 81/63.1 |
| D586,634 | S | 2/2009 | Lai | D8/21 |
| 2003/0188605 | A1 | 10/2003 | Chang | 81/60 |
| 2003/0196522 | A1 | 10/2003 | Hu | 81/63.2 |
| 2003/0209108 | A1 | 11/2003 | DeKeuster et al. | 81/61 |
| 2005/0247167 | A1 | 11/2005 | Chaconas et al. | 81/63.2 |
| 2006/0230883 | A1 | 10/2006 | Ling et al. | 81/63.2 |
| 2007/0277652 | A1 | 12/2007 | Tuan-Mu | 81/63 |
| 2007/0295171 | A1 | 12/2007 | Johnson et al. | 81/177.2 |
| 2008/0092695 | A1 | 4/2008 | Hernandez | 81/63.1 |
| 2008/0196562 | A1 * | 8/2008 | Elliston et al. | 81/433 |
| 2008/0229887 | A1 | 9/2008 | Thompson et al. | 81/62 |
| 2008/0229889 | A1 | 9/2008 | Hopper et al. | 81/63.1 |
| 2008/0245194 | A1 | 10/2008 | Ross et al. | 81/63.1 |
| 2009/0193944 | A1 | 8/2009 | Yang | 81/465 |
| 2009/0205467 | A1 | 8/2009 | Gao | 81/63.2 |
| 2011/0209585 | A1 * | 9/2011 | Hsieh | 81/63 |
| 2011/0247463 | A1 * | 10/2011 | Yu | 81/124.4 |

* cited by examiner

BIT OR FASTENER DRIVER

BACKGROUND OF THE INVENTION

Field of the Invention

The present invention relates to bit or fastener drivers that are used to apply torque to loosen or tighten fasteners. The present invention provides improvements over the prior art drivers.

SUMMARY

One aspect of the invention relates to a tool that includes a first bit receiving socket, a second bit receiving socket, and an angled metal structure. The angled metal structure includes a first end connected with the first bit receiving socket and a second end connected with the second bit receiving socket.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one example of the invention, the structural components illustrated herein can be considered drawn to scale. It is to be expressly understood, however, that many other configurations are possible and that the drawings are for the purpose of example, illustration and description only and are not intended as a definition or to limit the scope of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION OF THE INVENTION

Figure 1:
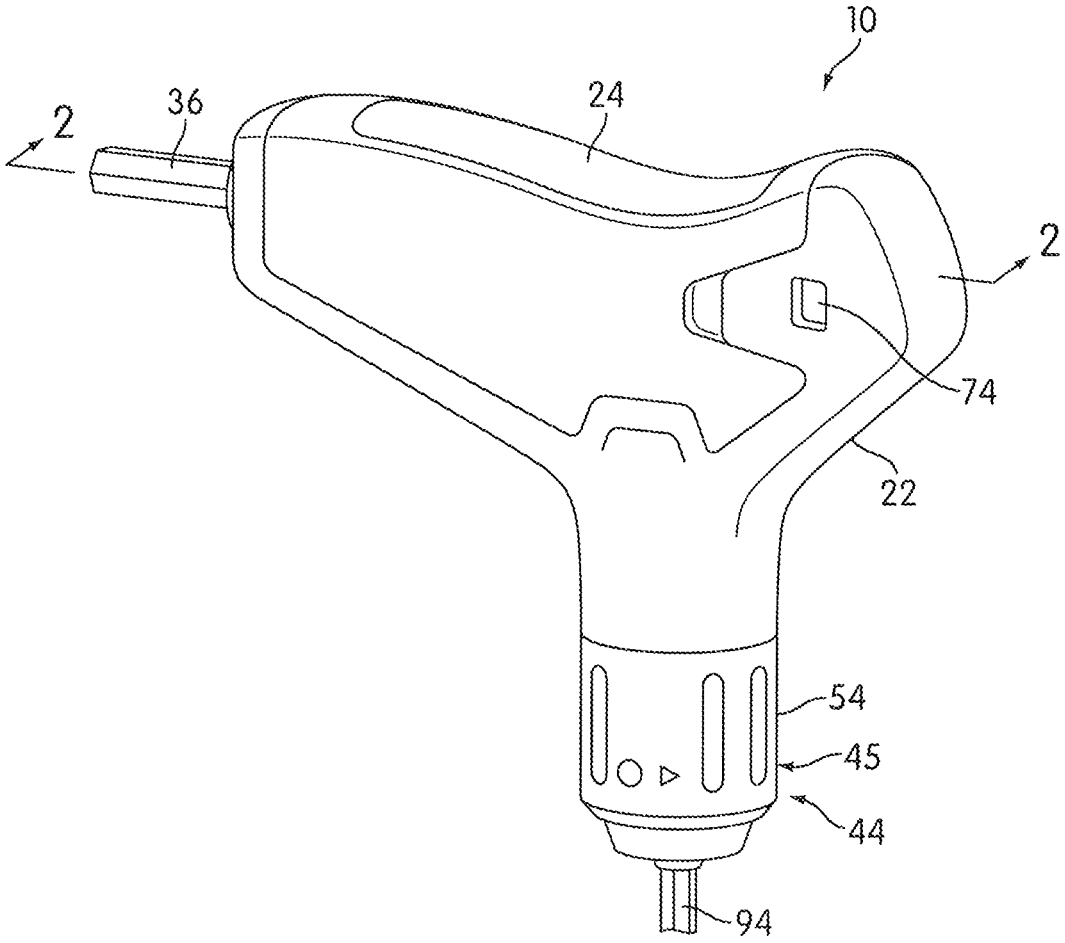
FIG. 1 shows a perspective view of a tool in accordance with an embodiment of the present invention.
Figure 2:
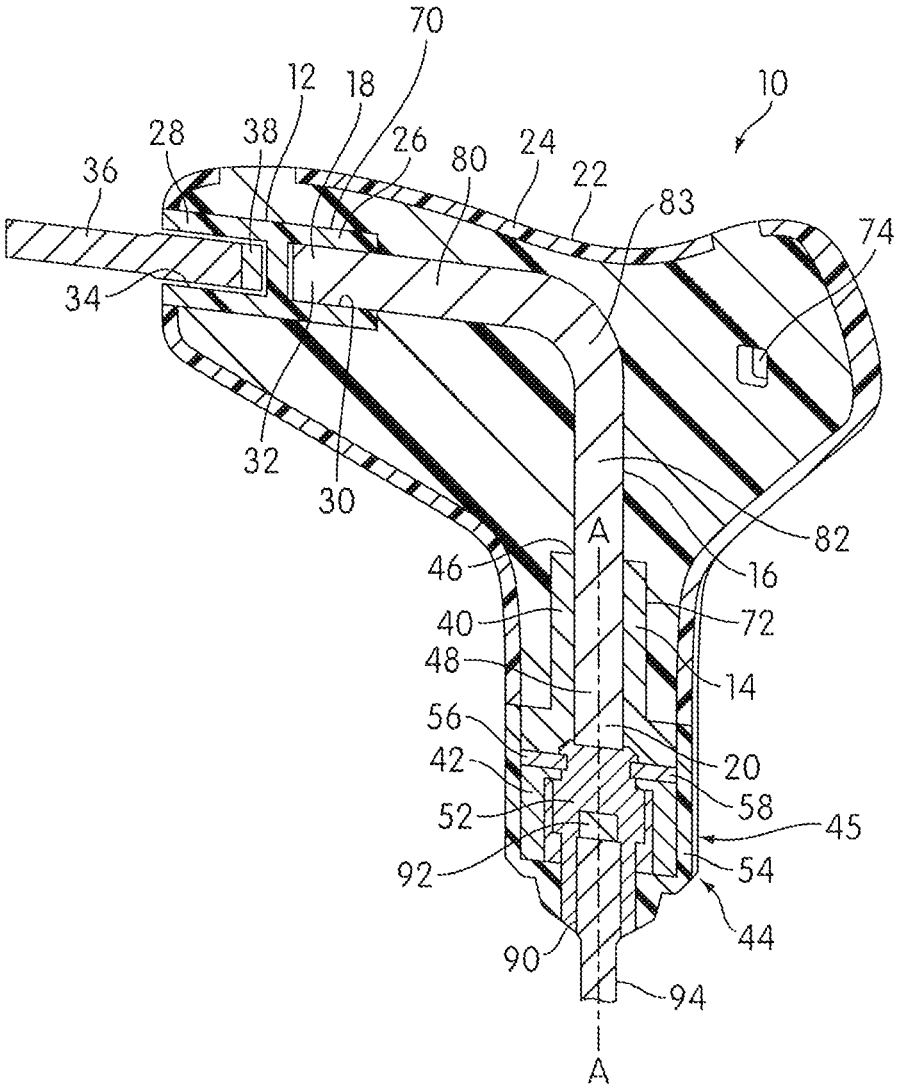
FIG. 2 shows a cross-sectional view of the tool taken through the line 2-2 in FIG. 1.
Figure 3:
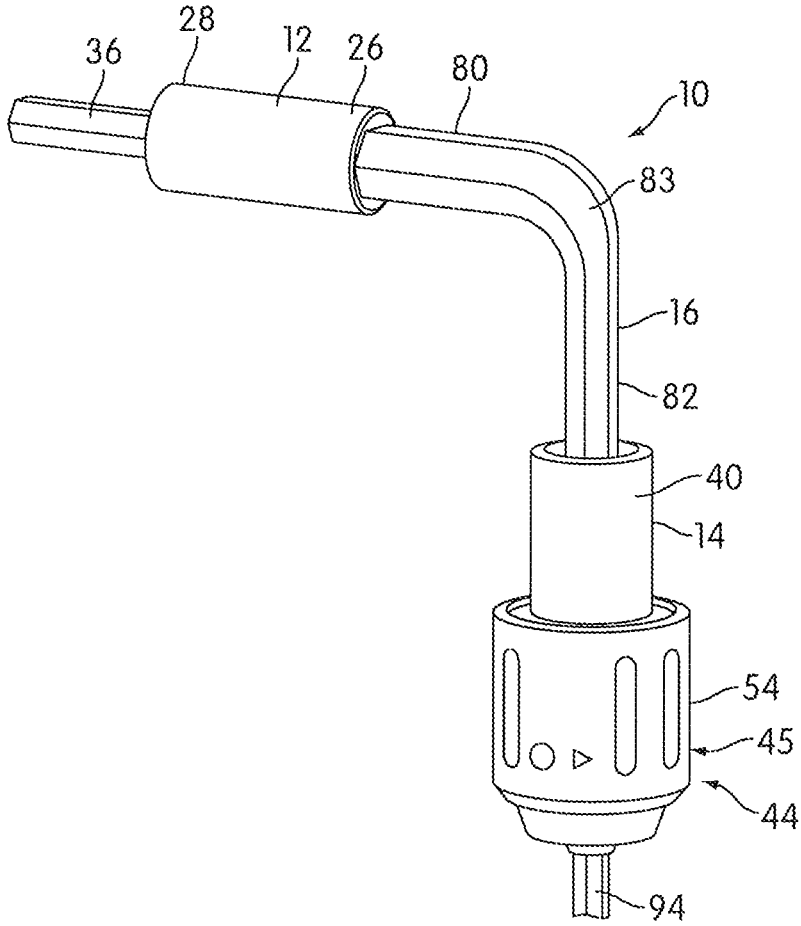
FIG. 3 shows a perspective view of the tool (with handle removed for illustrative clarity), in which a first end of an angled metal structure is connected with a first bit receiving socket and a second end of the angled metal structure is connected with a second bit receiving socket in accordance with an embodiment of the present invention.

FIGS. 1, 2 and 3 show a tool 10 in accordance with an embodiment of the present invention. The tool 10 (such as a hex key tool) includes a first bit receiving socket 12, a second bit receiving socket 44, and an angled metal structure 16. The angled metal structure 16 includes a first end 18 connected with the first bit receiving socket 12 and a second end 20 connected with the second bit receiving socket 44. Specifically; in one embodiment, the second end 20 of the angled metal structure 16 is received in a fixed portion 14 of the second bit receiving socket 44. The tool 10 further includes a handle 22 that at least partially surrounds the angled metal structure 16.

In one embodiment, the first bit receiving socket 12 is made from a metal material. In one embodiment, the first bit receiving socket 12 is made from a steel material. In one embodiment, the first bit receiving socket 12 is made from a zinc casting material. In one embodiment, the first bit receiving socket 12 is made from a CRV plastic material. In one embodiment, the first bit receiving socket 12 is formed from cold formed metal. In other embodiments, the first bit receiving socket 12 may be forged, cast, rolled, or formed from stamped sheet metal, extrusion, or metal injection molding. In one embodiment, the first bit receiving socket 12 may be formed from a cold forging operation.

The first bit receiving socket 12 includes a connector end 26 and a bit receiving end 28 axially opposite the connector end 26. In one embodiment, the connector end 26 is constructed and arranged to be connected with the angled metal structure 16, and the bit receiving end 28 is constructed and arranged to be removably coupled to a tool bit 36 (e.g., having a predetermined size and configuration). The torque applied to the tool 10 by a user can be transmitted through the first bit receiving socket 12 to the tool bit 36 to effect rotation of the tool bit 36.

The connector end 26 includes an angled metal structure receiving opening 30 that is constructed and arranged to receive a first end portion 32 of the angled metal structure 16. In one embodiment, the first bit receiving socket 12 is non rotatably fixed to the angled metal structure 16.

In one embodiment, the connector end 26 of the first bit receiving socket 12 is connected to the angled metal structure 16 by any attachment mechanism as would be appreciated by one skilled in the art. In one embodiment, the attachment mechanism includes, but not limited to, welding, interlocking fitting, friction fitting, snap fitting, or adhesive bonding. In another embodiment, the angled metal structure 16 is integrally formed (e.g., by metal casting) with the first bit receiving socket 12.

In another embodiment, the angled metal structure receiving opening 30 of the first bit receiving socket 12 is constructed and arranged to interlock with the first end portion 32 of the angled metal structure 16 so as to provide a fixed connection between the first bit receiving socket 12 and the angled metal structure 16.

In one embodiment, the angled metal structure receiving opening 30 may have a round shaped cross-sectional configuration, a square shaped cross-sectional configuration, or a hexagonal shaped cross-sectional configuration. As will be appreciated by those skilled in the art reading this specification, other shaped cross-sectional configuration can be used for the metal structure receiving opening 30 as long as the angled metal structure receiving opening 30 is configured to receive (and/or connect or interlock with) the first end portion 32 of the angled metal structure 16.

The bit receiving end 28 of the first bit receiving socket 12 includes a bit receiving opening 34 that is constructed and arranged to receive the tool bit 36. In one embodiment, a permanent magnet 38 may be fixed in the base of the bit receiving opening 34 in order to retain the tool bit 36 in use. In one embodiment, surfaces of the bit receiving opening 34 are configured to engage in torque transmitting relation with corresponding surfaces on the tool bit 36, when the tool bit 36 received in the bit receiving opening 34. Torque is applied to the tool 10 to effect the rotation of the tool bit 36 via the engagement between the surfaces of the bit receiving opening 34 and the corresponding surfaces on the tool bit 36.

In one embodiment, the bit receiving opening 34 may be have a round shaped cross-sectional configuration, a square shaped cross-sectional configuration, or a hexagonal shaped cross-sectional configuration. As will be appreciated by those skilled in the art reading this specification, other shaped cross-sectional configuration can be used for the bit receiving opening 34 as long as the bit receiving opening 34 is configured to receive the tool bit 36.

In one embodiment, the angled metal structure 16 is made from a steel material. In one embodiment, the angled metal structure 16 may be forged, cast, rolled, or formed from cold formed metal, stamped sheet metal, extrusion, or metal injection molding. In one embodiment, the angled metal structure 16 is L-shaped.

In one embodiment, the angled metal structure 16 may have a round shaped cross-sectional configuration, a square shaped cross-sectional configuration, or a hexagonal shaped cross-sectional configuration. As will be appreciated by those skilled in the art reading this specification, other shaped cross-sectional configuration can be used for the angled metal structure 16 as long as the first end of the angled metal structure 16 is configured to be received in and connected with the first bit receiving socket 12 and the second end of the angled metal structure 16 is configured to be received in and connected with the second bit receiving socket 44.

In one embodiment, the shape and the configuration of the first end portion 32 of the angled metal structure 16 may be different from the shape and configuration of a second end portion 48 of the angled metal structure 16. In such an embodiment, the shape and the configuration of the metal structure receiving opening 30 of the first bit receiving socket 12 (that receives the first end portion 32 of the angled metal structure 16) is different from the shape and the configuration of a metal structure receiving opening 46 of the fixed portion 14 of the second bit receiving socket 44 (that receives the second end portion 48 of the angled metal structure 16).

In one embodiment, the angled metal structure 16 includes a first leg member 80 and a second leg member 82, and a connecting portion 83 that connects the first leg member 80 and the second leg member 82. In one embodiment, the first leg member 80 and the second leg member 82 are disposed to form a 90° angle. In other embodiment, more broadly, the angle between the first leg member 80 and the second leg member 82 can be between 60° to 120°. As noted above, the first end portion 32 of the first leg member 80 is constructed and arranged to be received in the metal structure receiving opening 30 of the first bit receiving socket 12. The second end portion 48 of the second leg member 82 is constructed and arranged to be received in the metal structure receiving opening 46 of the fixed portion 14 of the second bit receiving socket 44.

The angled metal structure 16 is configured to provide strength to the tool 10, when the first bit receiving socket 12 and/or the second bit receiving socket 44 are subject to a high level of torque. The angled metal structure 16 is configured to provide strength to the tool 10 to resist torque and bending loads of the first bit receiving socket 12 and/or the second bit receiving socket 44.

In one embodiment, the fixed portion 14 of the second bit receiving socket 44 is made from a metal material. In one embodiment, the fixed portion 14 of the second bit receiving socket 44 is made from a steel material. In one embodiment, the fixed portion 14 of the second bit receiving socket 44 is made from a zinc casting material. In one embodiment, the fixed portion 14 of the second bit receiving socket 44 is made from a CRV plastic material. In one embodiment, the fixed portion 14 of the second bit receiving socket 44 is formed from cold formed metal. In other embodiments, the fixed portion 14 of the second bit receiving socket 44 may be forged, cast, rolled, or formed from stamped sheet metal, extrusion, or metal injection molding. In one embodiment, the fixed portion 14 of the second bit receiving socket 44 may be formed from a cold forging operation. In one embodiment, the fixed portion 14 of the second bit receiving socket 44 is identical to or substantially the same as the first bit receiving socket 12. In such embodiment, the bit receiving sockets 12, 44 would not be capable of rotation relative to the angled metal structure 16.

In another embodiment, the second bit receiving socket 44 includes a ratchet assembly 45. In such embodiment, the second bit receiving socket 44 is referred to as a ratcheting socket. In such embodiment, as illustrated, the fixed portion 14 of the second bit receiving socket or ratcheting socket 44 includes a connector end portion 40 and a ratchet structure receiving end portion 42 axially opposite the connector end portion 40. In one embodiment, the connector end portion 40 is constructed and arranged to be connected with the angled metal structure 16, and the ratchet structure receiving end portion 42 is constructed and arranged to receive a ratchet structure 52. As will be clear from the discussions below, the ratchet structure 52 includes a tool bit receiving opening 90 to receive a tool bit 94 therein.

In one embodiment, the ratchet assembly 45 may be considered to be part of the bit receiving socket 44. In another embodiment, the ratchet assembly 45 may be separate from the second bit receiving socket 44, and the ratchet structure when received in and connected to the second bit receiving socket 44 is configured to receive the tool bit 94.

The connector end portion 40 of the second bit receiving socket 44 includes the metal structure receiving opening 46 that is constructed and arranged to receive the second end portion 48 of the angled metal structure 16. In one embodiment, the connector end portion 40 of the second bit receiving socket 44 is connected to the angled metal structure 16 by any attachment mechanism as would be appreciated by one skilled in the art. In one embodiment, the attachment mechanism includes, but not limited to, welding, interlock fitting, friction fitting, snap fitting, or adhesive bonding. In another embodiment, the angled metal structure 16 is integrally formed (e.g., by metal casting) with the second bit receiving socket 44.

In another embodiment, the metal structure receiving opening 46 of the second bit receiving socket 44 is constructed and arranged to interlock with the second end portion 48 of the angled metal structure 16 so as to provide a connection between the second bit receiving socket 44 and the angled metal structure 16.

In one embodiment, the metal structure receiving opening 46 may have a round shaped cross-sectional configuration, a square shaped cross-sectional configuration, or a hexagonal shaped cross-sectional configuration. As will be appreciated by those skilled in the art reading this specification, other shaped cross-sectional configuration can be used for the metal structure receiving opening 46 as long as the metal structure receiving opening 46 is configured to receive (and/or connect or interlock with) the second end portion 48 of the angled metal structure 16.

In one embodiment, the ratchet assembly 45 of the ratcheting socket 44 may include the ratchet structure 52, a control sleeve 54, and pawls 56 and 58 movably engaged with the ratchet structure 52. As will be appreciated by those skilled in the art, ratchet structure 52 may include individual components not shown.

In one embodiment, the ratchet structure 52 may include the tool bit receiving opening 90. In one embodiment, a permanent magnet 92 may be fixed in the base of the tool bit receiving opening 90 in order to retain the tool bit 94 in use.

The tool bit 94 mounted in the tool bit receiving opening 90 in the ratchet structure 52 is rotatable about a longitudinal axis A-A of the tool bit 94.

In one embodiment, the ratchet structure 52 is in the form of a gear. In one embodiment, the ratchet structure 52 includes a plurality of circumferentially spaced gear teeth on an outer surface of the ratchet structure 52.

In one embodiment, the control sleeve 54 is rotatably mounted on a portion of the second bit receiving socket 44. The control sleeve 54 may be rotated between an intermediate, non-ratcheting position, and one or more ratcheting positions (e.g., first and second ratcheting positions). The control sleeve 54 is located in each of these positions by a spring loaded ball (i.e., which is mounted in a radial blind bore in of the second bit receiving socket 44) that selectively engages in a circumferential series of notches disposed on an inner surface of the control sleeve 54.

In one embodiment, the pawls 56 and 58 are spring loaded. That is, the ratchet assembly 45 include spring member(s) (not shown) that is constructed and arranged to urge the first and the second pawls 56 and 58 to their engaging positions. In their engaging positions, the first and second pawls 56 and 58 are engagement with the gear teeth of the ratchet structure 52 to prevent the rotation of the ratchet structure or gear 52 (in each direction i.e., clockwise direction or anticlockwise direction) relative to the second bit receiving socket 44.

The rotation of the control sleeve 54 between an intermediate, non-ratcheting position and one or more ratcheting positions is translated to the pawls 56 and 58 via a control member (not shown) and the spring member(s) (not shown) (connected between the control member and the pawls 56 and 58). In one embodiment, the pawls 56 and 58 are pushed into and out of engagement with the gear teeth of the ratchet structure or gear 52 by the control member which is in contact with the control sleeve 54. Connected to the control member are the spring member(s) (not shown) which acts on the respective pawls 56 and 58 to keep them in their engaging positions.

The ratchet assembly 45 generally includes an intermediate, non-ratcheting state, a first ratcheting state and a second ratcheting state. When the ratchet assembly 45 is in the non-ratcheting state (i.e., the control sleeve 54 is in the intermediate, non-ratcheting position), the first and second pawls are engagement with the gear teeth of the ratchet structure or gear 52 to prevent the rotation of the ratchet structure or gear 52 in each direction (i.e., clockwise or anticlockwise) relative to the second bit receiving socket 14.

When the ratchet assembly 45 is in the first ratcheting state (i.e., the control sleeve 54 is turned in the clockwise direction from the intermediate non-ratcheting position to the first ratchet position), the first pawl 56 is in engagement with the gear teeth of the ratchet structure or gear 52 and the second pawl 58 is out of engagement with the gear teeth of the ratchet structure or gear 52. In the first ratcheting state, rotation of the handle 22 in the clockwise direction turns the tool bit 94 in the same direction, whereas rotation of the handle 22 in the anti-clockwise direction does not rotate the tool bit 94, since the first pawl 56 is in engagement with the gear teeth of the ratchet structure or gear 52.

When the ratchet assembly 45 is in a second ratcheting state (i.e., the control sleeve 54 is turned in the anti-clockwise direction from the intermediate non-ratcheting position to the second ratchet position), the second pawl 58 is in engagement with the gear teeth of the ratchet structure or gear 52 and the first pawl 56 is out of engagement with the gear teeth of the ratchet structure or gear 52. In the second ratcheting state, rotation of the handle 22 in the anti-clockwise direction turns the tool bit 94 in the same direction, whereas rotation of the handle 22 in the clockwise direction does not rotate the tool bit 94, since the second pawl 58 is in engagement with the gear teeth of the ratchet structure or gear 52.

In yet another embodiment, instead of gear with gear teeth, the ratchet structure may include any driven structures or wheels that are constructed and arranged to engage with pawl by a friction contact arrangement or a forced contact arrangement, as would be appreciated by one skilled in the art reading this specification. In such embodiments, pawl or other drive structure may include a friction contact arrangement or any other similar contact arrangement that is constructed and arranged to engage with the driven structures.

In various embodiments, the construction and the arrangement of the ratchet assembly 45 can be any of the types described in commonly assigned U.S. Pat. Nos. 5,535,648; 6,186,030; 6,305,248; and 7,287,448, just for example. Each of these patents are hereby incorporated by reference in their entirety.

In one embodiment, both the first bit receiving socket 12 and the second bit receiving socket 44 may be non rotatably fixed (i.e., non-ratcheting type) to the angled metal structure 16. In another embodiment, both the first bit receiving socket 12 and the second bit receiving socket 44 may include the ratchet structures described above.

As noted above, in one embodiment, the handle 22 is constructed and arranged to at least partially surround the angled metal structure 16. In one embodiment, the handle 22 is made from a plastic material. In another embodiment, the handle 22 is made from a rubber material. In one embodiment, the handle 22 generally has a T-shaped configuration. In one embodiment, the handle 22 includes a hanging aperture 74 that is constructed and arranged to provide a way to hang the tool 10 for storage when not in use.

In one embodiment, as shown in FIG. 2, the handle 22 includes a first opening 70 and a second opening 72. The first opening 70 of the handle 22 is constructed and arranged to receive the first bit receiving socket 12 and the second opening 72 of the handle 22 is constructed and arranged to receive the second bit receiving socket 44.

In one embodiment, the handle 22 of the tool 10 may be overmolded with a grip 24 to protect and reinforce the handle 22. In one embodiment, the grip 24 may be made from deformable material to enhance manual grasping and comfort. In one embodiment, the grip 24 is made of an elastomeric material, a rubber based material, a plastic based material or other suitable material. Optionally, the grip 24 can be ergonomically shaped. In one embodiment, a surface texture or pattern (e.g., ribbed) may be provided on the grip 24. The surface texture or pattern is constructed and arranged to improve the grip of the user. The surface texture or pattern may be provided by knurling, sand blasting, rubber coating, or any other surface texturing methods known in the art. In one embodiment, the grip 24 may include a slip-resistant surface that is constructed and arranged to be used in all weather conditions. In one embodiment, the grip 24 may include a cushioned grip. In one embodiment, the handle 22 may have advertising or promotional information such as indicia (not shown) for identifying the product and/or manufacturer to the customers.

In one embodiment, the bits 36 and 94 may be in the forth of a screw bit that is used for driving screws into a work-piece. In one embodiment, the bits 36 and 94 may be a flat head screw bit, a cross head (or Phillips) screw bit, a square (or Robertson) screw bit, a star (i.e., six point) screw bit, a Pozidriv® (i.e., positive drive) screw bit or another type bit for engaging with a work-piece. The bits 36 and 94 are not limited to screw bits and may include any other type of bits or tools.

In another embodiment, instead of the bits 36 and 94, the tool 10 may receive hollow shaft members into the first bit receiving socket 12 and the second bit receiving socket 44 such that the hollow shaft members of the first bit receiving socket 12 and the second bit receiving socket 44 are configured to receive socket wrench heads, Allen wrench heads, and any other type of tools for applying torque to fasteners. In one embodiment, both ends of the tool 10 can receive hex tools or hex bits of the same or different dimensions.

In one embodiment, the first bit receiving socket 12 is constructed and arranged to receive short tool bits, while the second bit receiving socket 44 is constructed and arranged to receive long tool bits (e.g., tool bits having a length between 2.5 mm and 10 mm).

In one embodiment, the angled metal structure 16 provides a simple, easy and inexpensive way of joining the first bit receiving socket 12 and the second bit receiving socket 44.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A tool comprising:

a first bit receiving socket;

a second bit receiving socket comprising a connector end portion and a ratchet structure receiving end portion axially opposite the connector end portion, the ratchet structure receiving end portion of the second bit receiving socket constructed and arranged to receive a ratchet assembly therein;

an integrally formed angled metal structure having a first end connected with the first bit receiving socket and a second end, the second end being fixed in a structure receiving opening in the connector end portion of the second bit receiving socket such that the second end of the integrally formed angled metal structure and the connector end portion of the second bit receiving socket form a two-piece connected structure, the integrally formed angled metal structure including a first leg member, a second leg member, and a connecting portion connecting the first leg member and the second leg member; and an overmolded handle formed over the integrally formed angled metal structure, the overmolded handle fully covering each of the first leg member, the second leg member and the connecting portion and covering at least portions of the first bit receiving socket and the second bit receiving socket, wherein the connecting portion that is fully covered by the overmolded handle between the first and second leg members provides a direct torque transmission path, through the overmolded handle, between the first and second leg members, and wherein the connector end portion of the second bit receiving socket is surrounded by the overmolded handle.

2. The tool of claim 1, wherein the first bit receiving socket is made from a metal material.

3. The tool of claim 2, wherein the first bit receiving socket is made from a steel material.

4. The tool of claim 1, wherein the first bit receiving socket is non rotatably fixed to the angled metal structure.

5. The tool of claim 1, wherein the first bit receiving socket includes a bit receiving opening constructed and arranged to receive a replaceable tool-bit therein and an angled metal receiving opening constructed and arranged to receive the first end of the angled metal structure.

6. The tool of claim 1, wherein the connector end portion is a fixed portion that is fixedly connected with the second end of the angled metal structure.

7. The tool of claim 6, wherein the fixed portion of the second bit receiving socket is made from a steel material.

8. The tool of claim 6, wherein the first bit receiving socket and the fixed portion of the second bit receiving socket are formed from cold formed metal.

9. The tool of claim 8, wherein the angled metal structure is constructed and arranged to resist torque and bending loads of the first bit receiving socket and/or the second bit receiving socket.

10. The tool of claim 6, the ratchet assembly is coupled to the fixed portion of the second bit receiving socket.

11. The tool of claim 10, wherein the ratchet assembly is constructed and arranged to allow for rotation of the tool in one direction and locking of the tool in the other direction.

12. The tool of claim 10, wherein the ratchet assembly comprises a pawl, a control sleeve and a ratchet structure, the pawl is movably engaged with the ratchet structure.

13. The tool of claim 12, wherein the control sleeve is rotatably mounted on a portion of the second bit receiving socket and is constructed and arranged to be rotated between an intermediate, non-ratcheting position, and one or more ratcheting positions.

14. The tool of claim 13, wherein the control sleeve is located in each of the non-ratcheting position and the one or more ratcheting positions by a spring loaded ball that is mounted in a bore of the second bit receiving socket and is constructed and arranged to be selectively engaged in a circumferential series of notches disposed on an inner surface of the control sleeve.

15. The tool of claim 6, wherein the fixed portion of the second bit receiving socket is made from a metal material.

16. The tool of claim 1, wherein the angled metal structure is made from a metal material.

17. The tool of claim 16, wherein the angled metal structure is made from a steel material.

18. The tool of claim 1, wherein the handle comprises a plastic material.

19. The tool of claim 1, wherein the handle comprises a rubber material.

20. The tool of claim 1, wherein the handle has T-shaped configuration.

21. The tool of claim 1, wherein the integrally molded angled metal structure is L-shaped.

22. The tool of claim 1, wherein the first and the second leg members are disposed to form a 90° angle therebetween.

23. The tool of claim 1, wherein the first leg member being at an angle between 60° and 120° with respect to the second leg member.

24. The tool of claim 1, wherein the connector end portion of the second bit receiving socket and the second end of the integrally formed angled metal structure are connected to each other using friction fitting attachment mechanism.

25. The tool of claim 1, wherein the ratchet structure includes a tool bit receiving opening that is constructed and arranged to receive a tool bit, and wherein the base of the tool bit receiving opening includes a permanent magnet to retain the tool bit in use.

26. The tool of claim 1, wherein the first bit receiving socket includes a tool bit receiving opening that is constructed and arranged to receive a tool bit, and wherein the base of the tool bit receiving opening includes a permanent magnet to retain the tool bit in use.

* * * * *